United States Patent [19]

Herigstad et al.

[11] Patent Number: 4,863,335

[45] Date of Patent: Sep. 5, 1989

[54] AUTOMATIC GUIDED VEHICLE ROLL-HANDLING SYSTEM

[75] Inventors: David P. Herigstad, Aberdeen; Robert E. Sturm, Hoquiam, both of Wash.

[73] Assignee: Haines & Emerson, Inc., Hoquiam, Wash.

[21] Appl. No.: 173,310

[22] Filed: Mar. 25, 1988

[51] Int. Cl.[4] ..... B60P 1/02

[52] U.S. Cl. ..... 414/495; 414/664; 414/754; 414/911

[58] Field of Search ..... 414/911, 908, 495, 498, 414/754, 277, 279, 281, 282, 664, 663, 266, 352, 32, 95, 104

[56] References Cited

U.S. PATENT DOCUMENTS

| | | | |
|---|---|---|---|
| D. 259,552 | 6/1981 | Lindfors | D34/37 |
| D. 261,126 | 11/1981 | Lindfors | D34/34 |
| 1,286,801 | 12/1918 | Schumacher | 414/754 |
| 2,452,481 | 10/1948 | Morehead et al. | 414/428 |
| 2,804,218 | 8/1957 | Sylvester et al. | 414/282 |
| 3,138,273 | 6/1964 | Gray | 414/754 |
| 3,323,661 | 6/1967 | Chasar | 414/275 |
| 3,338,433 | 8/1967 | Mattson et al. | 414/286 |
| 3,391,795 | 7/1968 | Finlayson | 211/134 |
| 3,536,209 | 10/1970 | Burch et al. | 414/275 |
| 3,592,348 | 7/1971 | Atwater | 414/277 |
| 3,593,823 | 7/1971 | Thompson | 187/11 |
| 3,595,176 | 7/1971 | Broling | 105/367 |
| 3,698,344 | 10/1972 | Maeda | 414/754 |
| 3,704,800 | 12/1972 | Redelman | 414/667 |
| 3,709,380 | 1/1973 | Cole | 414/663 |
| 3,746,189 | 7/1973 | Burch et al. | 414/273 |
| 3,753,591 | 8/1973 | Pratt | 296/35 A |
| 3,764,026 | 10/1973 | Olah | 414/199 |
| 3,788,499 | 1/1974 | Burns et al. | 414/284 |
| 3,797,678 | 3/1974 | Richardson | 414/284 |
| 3,805,973 | 4/1974 | Thompson | 414/284 |
| 3,842,689 | 10/1974 | Bagge | 74/479 |
| 3,855,935 | 12/1974 | Busam | 104/48 |
| 3,865,266 | 2/1975 | Redelman | 414/498 |
| 3,866,767 | 2/1975 | Zollinger et al. | 414/279 |
| 3,873,902 | 3/1975 | Burch | 318/594 |
| 3,902,606 | 9/1975 | Ronbeck | 414/737 |
| 3,905,485 | 9/1975 | Shumaker | 414/663 |
| 3,920,105 | 11/1975 | Fernstrom | 192/22 R |
| 3,921,828 | 11/1975 | Suizu | 414/281 |
| 3,924,300 | 12/1975 | Hilger et al. | 414/281 |
| 3,978,995 | 9/1976 | Zollinger et al. | 414/279 |
| 4,018,343 | 4/1977 | Perhed | 414/222 |
| 4,023,639 | 5/1977 | Perhed | 180/21 |
| 4,067,451 | 1/1978 | Winters | 414/754 |
| 4,127,182 | 11/1978 | Thole | 180/98 |
| 4,129,103 | 12/1978 | Pichl | 123/52 R |
| 4,131,206 | 12/1978 | Kawada et al. | 414/352 |
| 4,136,909 | 1/1979 | Duttarer | 298/17 B |
| 4,236,255 | 11/1980 | Burgener et al. | 455/603 |
| 4,240,773 | 12/1980 | Terry | 414/664 |
| 4,265,582 | 5/1981 | Theobald | 414/279 |
| 4,268,207 | 5/1981 | Pipes | 414/277 |
| 4,273,494 | 6/1981 | Swain et al. | 414/266 |
| 4,279,328 | 7/1981 | Ahlbom | 187/9 R |
| 4,354,235 | 10/1982 | Blakeslee | 364/424 |
| 4,400,984 | 8/1983 | Ronbeck | 74/103 |
| 4,406,570 | 9/1983 | Duncan et al. | 414/282 |
| 4,427,331 | 1/1984 | Grebenstein et al. | 414/277 |
| 4,516,905 | 5/1985 | Cavin et al. | 414/911 |
| 4,541,049 | 9/1985 | Ahlbom | 364/424 |
| 4,640,661 | 2/1987 | Rasmussen | 414/619 |
| 4,690,601 | 9/1987 | Delius et al. | 414/95 |

FOREIGN PATENT DOCUMENTS 424779 9/1974 U.S.S.R. .

*Primary Examiner*—Andres Kashnikow
*Assistant Examiner*—Mark T. Le
*Attorney, Agent, or Firm*—Seed and Berry

[57] ABSTRACT

A low-profile, automatically guided vehicle is provided with a vertically raisable cradle which can carry a roll either in a bilge position or an upright position. The vehicle is used in a roll-handling system which enables the vehicle to pass beneath the spaced, parallel arms of a storage rack that can be holding a roll either in the upright or bilge position. The vehicle can pass beneath a set of rolls on the storage racks so that passage of the vehicle either for depositing a paper roll or lifting a paper roll from the storage rack can be in a single, common direction. A transfer table is provided which has articulated arms that can be vertically raised. The arms can be moved lengthwise to the direction of the lengthwise axis of the roll in a bilge position, the arms can be raised vertically, or the arms can be carried moved to the lengthwise axis of the roll on the transfer table. A method is disclosed for handling rolls in an advantageous first-in, first-out method wherein a roll at one end of a row of rolls can be accessed by passing a vehicle beneath all other rolls in that row.

9 Claims, 4 Drawing Sheets

FIG. 2
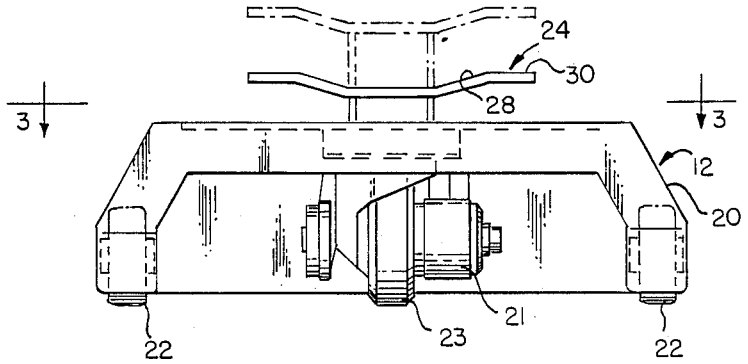
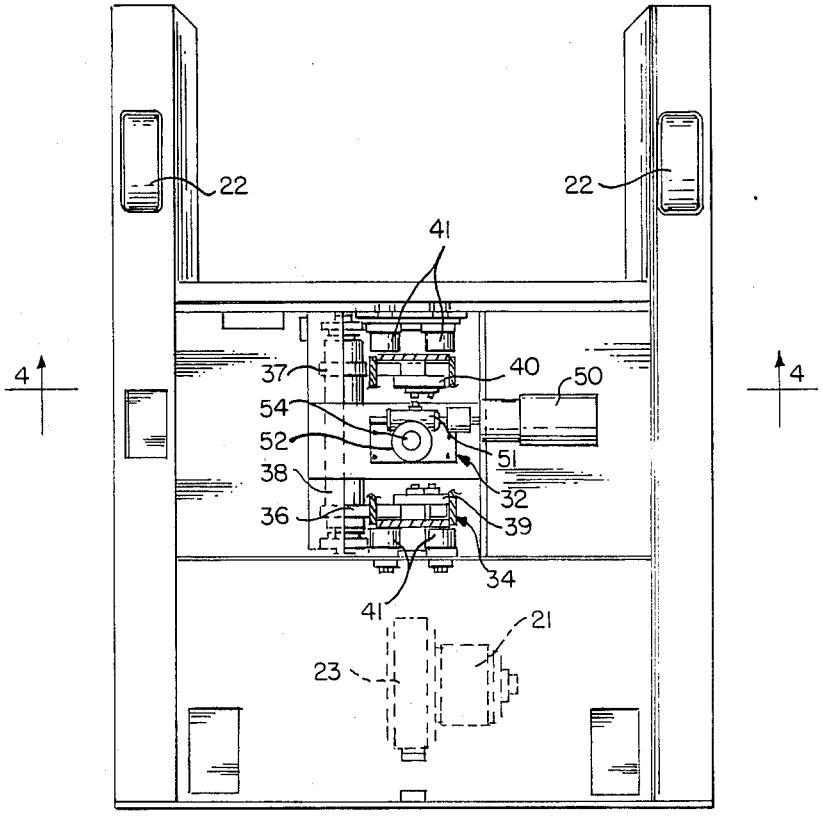
FIG. 3

FIG. 4
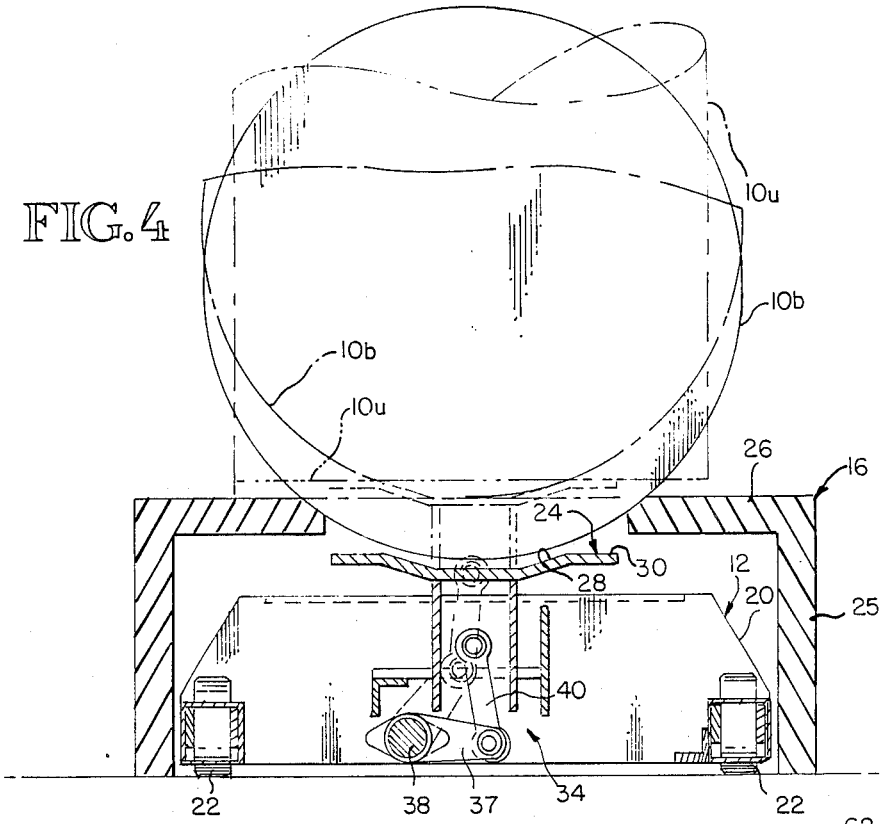
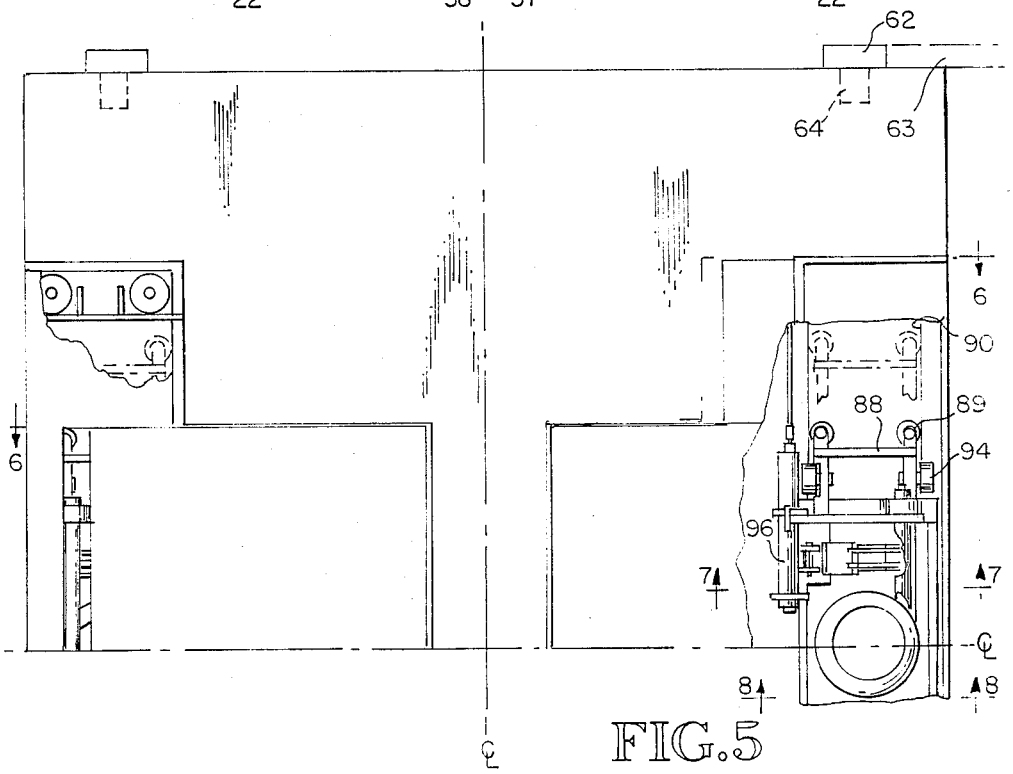
FIG. 5

FIG. 6
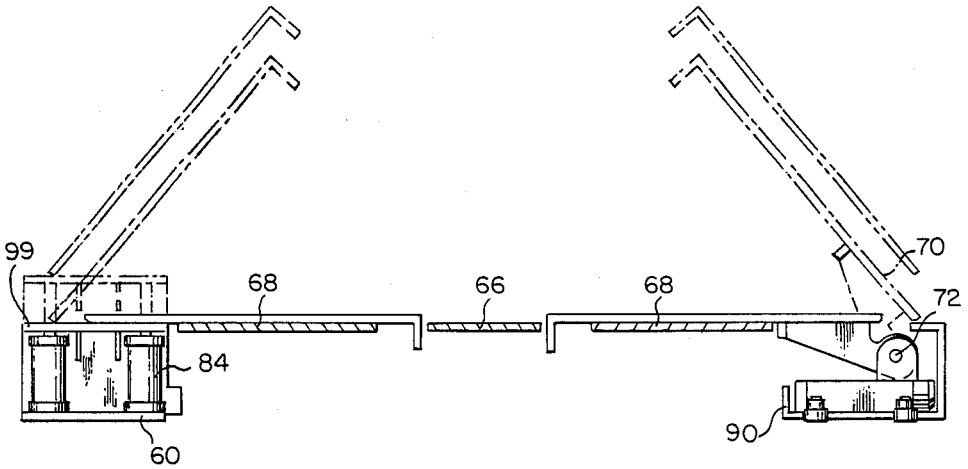
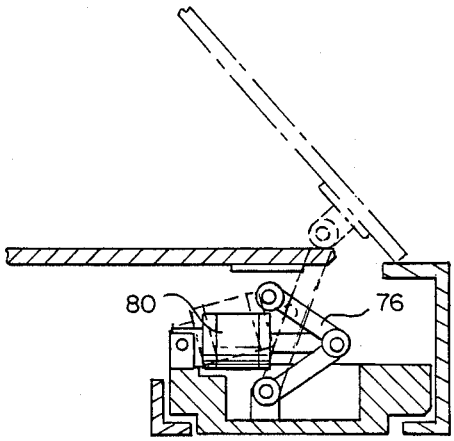
FIG. 7
FIG. 8
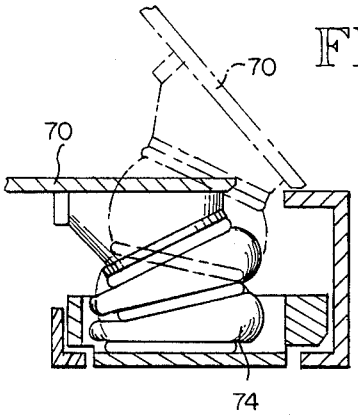

AUTOMATIC GUIDED VEHICLE ROLL-HANDLING SYSTEM

FIELD OF THE INVENTION

This invention relates to automatic apparatus for handling paper rolls and particularly for furnishing each web reel of a rotary printing press with a new web or roll of paper.

DESCRIPTION OF THE PRIOR ART

Printing presses require rolls of paper in large quantities. Generally there are several presses along a printing line, with each press carrying one or more rolls of paper on a reel. The reel is provided with spindles that engage the center core of the paper roll.

The paper rolls are stored in a warehouse and delivered to laydown areas adjacent the printing presses. The control of paper storage time in the laydown area is important as some paper, if stored for too long a time, will yellow or deteriorate and not be suitable for high quality printing. The yellowed roll may be used for lower quality printing.

The storing and delivery of the rolls to the laydown area, and the delivery of the rolls from the laydown area to the spindle of the printing press, require a large amount of equipment and expense for a printing company such as a newspaper publishing company.

The conventional technique for handling rolls for delivery to the printing presses is through the use of a conventional forklift truck. The truck has two forwardly protruding forks which lift the roll by placing the forks beneath the lower peripheral surface of the roll, lifting the roll off its support, and delivering the roll to another support or to a printing press transfer cart. A disadvantage with the conventional forklift truck is that it must be moved into and then reversed out of the storage racks. As a result, the handling of the rolls with a forklift and their selection for delivery to the laydown area, removal from the laydown area, and delivery to the printing press is greatly limited.

Another difficulty associated with delivering rolls to the printing press is that the positioning of the paper roll at the press location has conventionally been accomplished by placing the roll on a transfer cart. The transfer cart is then manually positioned beneath an empty spindle at a printing press for transfer of the paper roll to the spindle.

One approach to automating the transfer of the roll to the spindle of the printing press is shown in U.S. Patent No. 4,131,206. In this patent, a paper roll is delivered on a first truck to the vicinity of the printing press spindle, where it is rolled onto a second truck. The second truck can lift the first truck and move it horizontally to position the roll on the first truck into alignment with the spindle of the paper press.

SUMMARY OF THE INVENTION

It is an object of this invention to provide an automatic guided vehicle system for handling paper rolls at a printing press facility by supporting the rolls on a low-profile vehicle that can travel beneath rolls previously stored on aboveground storage racks.

It is another object of this invention to provide a method of handling paper rolls by positioning a vehicle entirely beneath a paper roll, lifting the roll and automatically guiding the roll to a storage rack capable of holding at least two paper rolls, guiding the vehicle beneath the rack while lifting the roll above the rack, and lowering the roll onto the rack, and in which the vehicle can pass beneath rolls already existing on the rack, either after delivery of a roll onto the rack or to access one of the end rolls at either end of the rack.

Basically these objects are obtained by providing low-profile vehicle having an automatically controllable guidance system and a vertically extendable roll support cradle. The roll support cradle advantageously can carry a roll on its peripheral surface, with the lengthwise axis of the roll being horizontal, or the cradle can carry the roll on its bottom surface, with the lengthwise axis of the roll being vertical. A position of the roll with its lengthwise axis being horizontal will be called a "bilge" position. A position of the roll with its lengthwise axis being vertical will be called an "on-end" or "upright" position.

The automatic guided vehicle is used in combination with racks having roll supporting bars which have a vertical height greater than the height of the vehicle with the roll support cradle retracted, but of a height capable of allowing the roll support cradle to extend above the support bars. In this manner, the vehicle can pass beneath rolls on the rack to selectively lift either a forwardmost or rearwardmost roll from a plurality of rolls on a rack. The vehicle can pass beneath the racks in a standard single direction, if desired, which is preferable so that the vehicle starts at the rearmost roll of the rack, passes beneath that roll and other rolls on the rack, and lifts the forwardmost roll from the rack for delivery to the printing press.

This system advantageously allows use of a method by which the first roll placed into a laydown area or temporary storage can be the first roll out. Similarly the second roll in a row of rolls can then become the second roll out and so on. This type of method assures that no roll of paper need be stored at the laydown area for too long a period merely because the transfer vehicle cannot access the rolls that were first delivered to that laydown area. The method also advantageously allows the vehicle to travel in a single direction beneath the laydown racks, making coordinating and operation of multiple vehicles in the storage area and press area much easier to control without vehicles colliding or being held up because of interference with another vehicle in the system. The unidirectional movement of the vehicle is also easier for control operations, making it easier to lay out the plant and determine the timing of movement of the various vehicles in the system.

Another feature of the invention is a transfer table for moving a paper roll into the spindle of the paper press after having received the roll from the automatic guided vehicle. The transfer table has a pair of spaced, articulated parallel arms which can be raised above the floor. The automatic guided vehicle then passes between these arms with the paper roll in the bilge position and elevated above the arms. The automatic guided vehicle lowers the roll onto these spaced, parallel arms and then leaves the transfer table by continuing its forward direction out the other end of the transfer table. This unidirectional movement reduces the chance of collision or interference with another vehicle that is approaching with a fresh roll to be delivered to that transfer table. It also allows the vehicle to travel on the discharge side of the printing presses while incoming rolls are delivered at the incoming side of the presses without the incoming and leaving vehicles having to interfere with one another on the same path.

The arms can be elevated, moved lengthwise to the direction of the lengthwise axis of the roll, and moved transverse to the lengthwise direction of the roll for positioning the roll between the chucks of the spindle at the printing press.

BRIEF DESCRIPTION OF THE FIGURES OF THE DRAWING

FIG. 2 is a fragmentary end elevation showing a typical automatic guided vehicle of this invention.

FIG. 3 is a fragmentary horizontal section taken along the line 3—3 of FIG. 2.

FIG. 4 is a fragmentary vertical section of a transfer table embodying the principles of the invention and taken along lines 4—4 of FIG. 3.

FIG. 5 is a plan view of one-half of a transfer table embodying principles of the invention.

FIG. 6 is a fragmentary vertical section taken along the line 6—6 of FIG. 5.

FIG. 7 is a fragmentary vertical section taken along the line 7—7 of FIG. 5.

FIG. 8 is a fragmentary vertical section taken along the line 8—8 of FIG. 5.

DETAILED DESCRIPTION OF THE INVENTION

Figure 1:
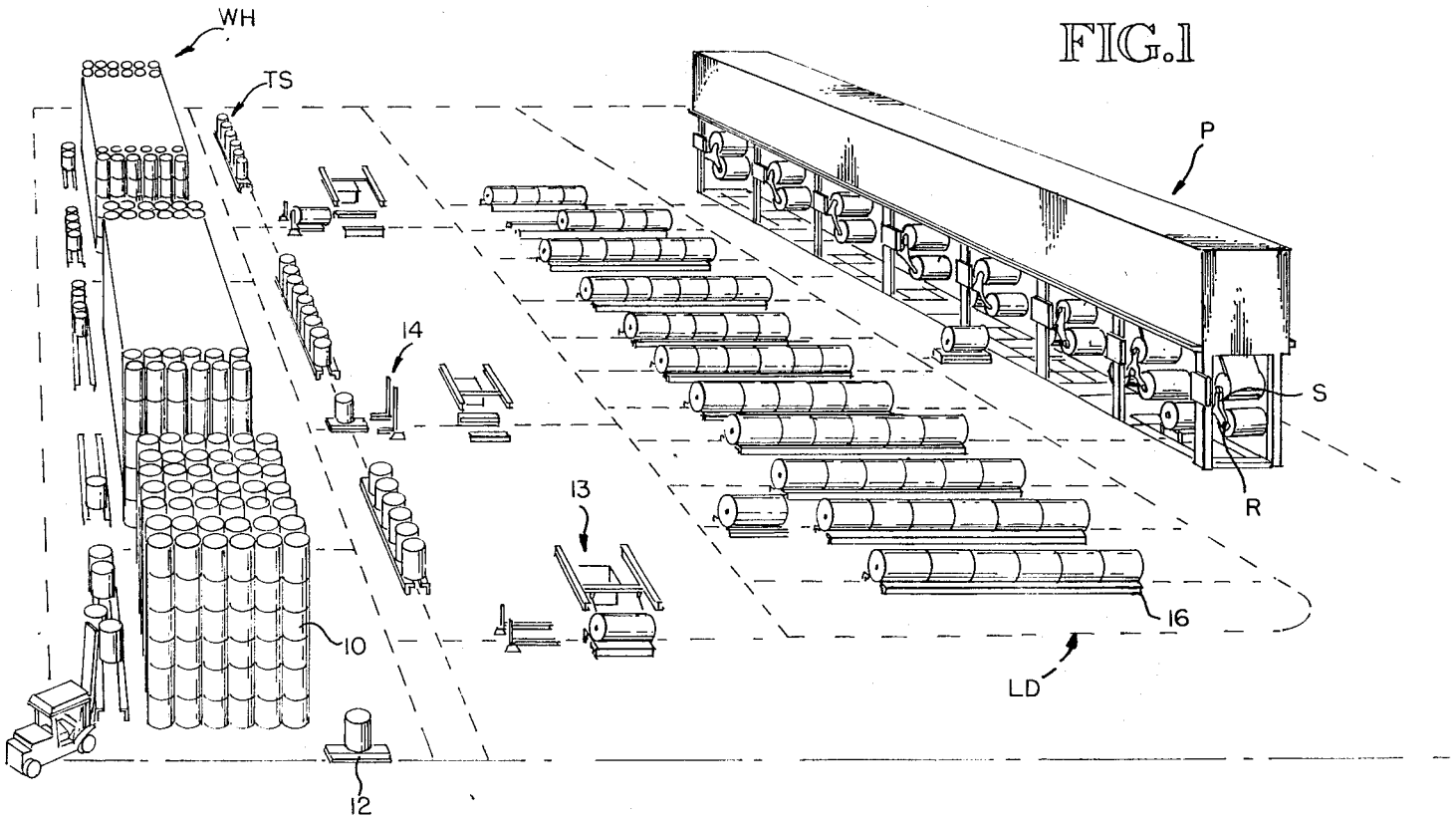
FIG. 1 is a schematic of an overall layout of a warehouse, laydown or temporary storage area, and printing press location.

As best shown in FIG. 1, a typical printing press facility has a warehouse WH, temporary storage racks TS, a laydown area LD, and a printing press area P where there are a plurality of presses in tandem.

At the printing press area P, each press will be provided with a reel R that has a plurality of spindles S. A roll is placed within chucks of the spindles in a storage or make-ready position. When the press is about to use up the roll then being actively fed to the printers, the next roll on the reel is positioned to be attached to the tail end of the active roll. In this way, by rotation of the reel to position the spindles from a storage position to an active position, empty spindles can be reloaded with fresh rolls of paper so that the press will always have available to it a roll of paper than can immediately be placed into an active condition.

The warehouse personnel usually store the rolls 10 in their upright position, one on top of the other. The rolls can be removed by various forklift or vacuum truck-lift equipment, as is well known in the art. The roll gets placed on the temporary storage racks TS.

At the temporary storage location TS, an automatic guided vehicle 12 begins its transferring of the rolls. The automatic guided vehicle 12 moves the rolls from one of the temporary storage racks by passing beneath the racks to lift a roll off the rack and delivers it to a downender 14. The downender is a conventional apparatus having a set of horizontal and vertical legs. The roll is placed on the horizontal legs by the automatic guided vehicle. The legs are then pivoted so that the roll is rotated from its upright position to the bilge position.

The automatic guided vehicle 12 then moves beneath the roll on the downender and further transports the roll from the downender to one of the laydown racks 16 at the laydown area LD. Finally, the vehicle takes a selected roll from the laydown area and delivers it to a transfer location at a particular printing press. The vehicle enters from one side of the press, delivers its load or roll onto a transfer table at the printing press, and passes outwardly through the other side of the printing press to return to another area in the printing press facility.

If desired, the vehicle can merely deliver the roll to a conventional transfer cart at one of the printing presses and leave the area without passing through the printing press. The roll is then manually propelled into position beneath the spindle at that particular press.

The automatically guided vehicle 12 is best shown in FIGS. 2 and 3 and includes a low-profile chassis 20 carried along the ground by a conventional automatic guidance system 21 that controls a steerable forward wheel 23. A rear set of wheels 22 supports the rear end of the vehicle. The vehicle is powered for motion both in the forward and rearward direction. The vehicle is generally guided by a wire which is embedded into the concrete of the floor of the printing press facility. Guided vehicles having propulsion, steerage, and guidance are well known and the details of these mechanisms are not necessary for an understanding of this invention.

The important detail of this invention is that the chassis 20 is of a low profile sufficient to fit beneath storage racks 16 and has an levatable cradle 24 for lifting a roll above the height of the racks 16.

As best shown in FIG. 4, a typical rack 16 is shown having a vertical leg 25 and a horizontal leg 26. A roll 10 can be in the upright position, as shown at 10*u*, or can be supported on the rack in the bilge position, as shown at 10*b*. The cradle 22 has a recess 28 for cradling the roll in its bilge position so that the roll will not roll off the cradle. The cradle also has a flat upper surface 30 to carry an upright roll, as shown in the double-dot, phantom line position with reference to numeral 10*u*. A cradle lifting mechanism 32 and a cradle guiding mechanism 34 are best shown schematically in FIGS. 3 and 4.

The cradle guiding mechanism 34 includes a pair of bottom links 36 and 37 which are fixed to a common shaft 38. The links 36 and 37 are pivotally connected to upper links 39 and 40, respectively. The links guide the cradle as it is moved vertically, keeping it from tipping fore and aft and cam rolls 41 guide the cradle keeping it from tipping transverse to the lengthwise axis of the roll.

A conventional jack mechanism is shown, the details of which will be mentioned only briefly for clarity. The jack mechanism includes a motor 50 which rotates a worm 51. The worm 51 meshes with and rotates a worm wheel 52. The worm wheel 52 is also internally threaded and meshes with a nonrotatable screw 54. The upper end of the screw is attached to the cradle 24. Rotation of the worm 51 rotates the worm wheel 52, which in turn causes the nonrotatable screw to thread its way up or down in the worm wheel 52. The cradle thus travels up or down with the upper end of the screw.

A preferred automatic guided vehicle 12 will be fully automatic, capable of carrying at least 4,000 pounds, capable of handling rolls up to 50" or more in diameter and up to 58" or more in length. A typical speed of operation will be approximately 200 feet per minute.

The transfer table is best shown in FIGS. 5–8 and includes a base 60 mounted on wheels 62 that run in tracks 63. The tracks 63 are positioned at right angles to the lengthwise axis of the roll in its bilge position within a reel R for movement of a roll horizontally toward or away from the spindles of a reel. The wheels are propelled by a conventional motor 64, shown schematically, the details of which are not necessary to an understanding of the invention.

Fixed to the top of the base are a horizontal central platform 66 and two side platforms 68. Mounted above these platforms are a pair of articulated arms 70, only one of which will be described. It should be understood that the opposite arm is identical and articulated in a similar fashion.

The arm 70 is pivotally mounted on a horizontal pivot shaft 72. In the lowered position, as shown in solid lines in FIG. 6, the arm forms an extension of the platform and serves as a working surface for a workman who is preparing a roll on a reel. The arm is pivoted by a conventional air bag tilt mechanism 74 (FIG. 8). The arm is locked in place by an over-center linkage 76 (FIG. 7) that is actuated by a pneumatic cylinder and piston 80. When the linkage is fully retracted to its over-center position, the arm cannot be lowered under the weight of a heavy roll.

The arms can also be raised vertically by sets of cylinders and pistons 84 (FIGS. 5 and 6) which move the arms, pivot mechanism, air bags, and over-centering locking mechanisms together as a unit.

The arms can also be moved lengthwise in the direction of the lengthwise axis of a roll by a carriage 88 which is guided in its lengthwise movement by guide rollers 89 moving in tracks 90. The carriage is supported on the tracks by rollers 94, which rotate about horizontal axes. An air-powered centering piston and cylinder 96 positions the carriage along the tracks 90. The tracks 90 form part of a framework 99 that is lifted by the piston rods of the piston-cylinders 84. Thus the arms 70, air bags 74, overcenter pivot mechanism 76, and carriage 88 are all lifted to raise the roll into the spindle. The cylinders 84 are mounted on the base 60.

In operation, the arms 70 will be elevated and the automatically guided vehicle driven 12 beneath the arms. The cradle on the automatically guided vehicle will be lowered to lower the roll onto the upper ends of the arms 70. The entire transfer table can then be moved on the tracks 63 perpendicular to the lengthwise axis of the roll between the chucks of a spindle. The roll can be further positioned along its lengthwise axis by the carriage 88 and can be elevated or lowered by the piston and cylinders 84.

As described above, the invention advantageously provides apparatus and methods for enhancing the delivery of paper rolls to a plurality of printing presses. The invention also illustrates and describes a unique transfer table positionable at the printing press for delivering the roll from the automatically guided vehicle to the reel of a printing press. While the preferred embodiments of the invention have been illustrated and described, it should be apparent that variations will be apparent to one of ordinary skill in the art. Accordingly, the invention is not to be limited to the embodiments illustrated in the drawings.

We claim:

1. Automatic guided paper roll-handling apparatus, comprising:

a low-profile vehicle having an automatically controllable guidance system and a vertically extendible roll support cradle for directly supporting the paper roll;

roll support racks having elongated, spaced support bars for holding stationary paper rolls in any location along said bars and an unrestricted path beneath and beyond said racks;

said vehicle being low enough to pass beneath said support bars; and said paper roll support cradle being retractable to lower a paper roll onto said support bars at any location therealong and extendible to a height sufficient to lift a paper roll of said support bars, and wherein the vehicle passes beneath paper rolls on the racks to selectively lift an endmost paper roll from a plurality of rolls on a rack and continues on the unrestricted path to remove the roll from the rack.

2. The apparatus of claim 1, said cradle having a curved bed for holding the curved peripheral surface of a roll and a flat bed above the curved bed for holding the flat end of a roll.

3. The apparatus of claim 1, including a paper printing press transfer table having spaced parallel arms, means for pivoting said arms to hold a roll in a raised position, and means for moving said transfer table to a set of paper roll holding spindles on a paper printing press.

4. Automatic guided paper roll-handling apparatus, comprising:

a low-profile vehicle having an automatically controllable guidance system and a vertically extendible roll support cradle;

roll support racks having spaced support bars for holding stationary paper rolls;

said vehicle being low enough to pass beneath said support bars;

said roll support cradle being retractable to lower a roll onto said support bars and extendible to a height sufficient to lift a roll off said support bars, whereby the vehicle can pass beneath rolls on the racks to selectively lift either a forwardmost roll or a rearwardmost roll from a plurality of rolls on a rack, including a roll downender for reorienting a roll from a position in which the roll's longitudinal axis is vertical to a horizontal bilge position, said downender having spaced horizontal and spaced vertical arms, said roll support cradle lowering a roll onto said horizontal arms;

means for pivoting said arms ninety degrees about a horizontal axis to pivot the roll from an upright to a bilge position with the roll's vertical axis horizontal; and said extendible support cradle being movable through said roll downender for delivering the roll, passing through the downender, and receiving the reoriented roll from the other side of the downender.

5. A method of handling paper rolls between racks at a paper printing press storage area, comprising:

positioning a vehicle entirely beneath a paper roll;

lifting the roll and automatically guiding the roll to a storage rack capable of holding at least two paper rolls;

guiding the vehicle beneath the rack while lifting the roll above the rack;

lowering the roll onto the rack;

guiding the vehicle out from under the roll and the rack, including the steps of delivering a second roll to a rack by guiding the vehicle beneath the rack and lowering the roll onto the rack adjacent to the first roll; and removing the first roll from the rack by guiding the vehicle in one direction first under the second roll to reach the first roll, lifting the first roll off the rack without engaging the second roll, and continuing the vehicle with the first roll in said one direction.

6. The method of claim 5 wherein said steps of delivering the roll and removing the roll are both done by guiding the vehicle in the same direction beneath the rack.

7. The method of claim 5, including the step of guiding the vehicle in a downender entering direction to deliver the roll with one position of orientation of the axis of the roll at a downender station, tilting the roll at the downender station to reposition the axis of the roll ninety degress, and removing the repositioned roll from the downender station by continuing the direction of the vehicle in the same downender entering direction to pass through the downender station to remove the roll.

8. A method of handling paper rolls between racks at a paper printing press storage area, comprising:

positioning a vehicle entirely beneath a paper roll;

lifting the roll and automatically guiding the roll to a storage rack capable of holding at least two paper rolls;

guiding the vehicle beneath the rack while lifting the roll above the rack;

lowering the roll onto the rack;

guiding the vehicle out from under the roll and the rack, including turning the roll from a roll lengthwise axis-up position to a roll lengthwise axis-horizontal bilge position;

guiding the vehicle and a roll with its lengthwise axis horizontal onto a transfer table having a pair of articulated arms;

guiding the vehicle beneath said articulated arms while lifting the roll above said articulated arms; and lowering the roll onto said transfer table arms.

9. Automatic guided paper roll-handling apparatus, comprising:

a low-profile vehicle having an automatically controllable guidance system and a vertically extendible roll support cradle;

roll support racks for holding stationary paper rolls;

roll downender means having spaced arms for receiving a roll with one axis of orientation and rotating the roll ninety degrees to a second axis of orientation;

said roll downender means having a vehicle path therethrough; and said vehicle passing beneath and through said roll support racks and said downender means for delivering and receiving rolls in a vehicle unidirectional path of movement.

* * * * *

UNITED STATES PATENT AND TRADEMARK OFFICE

CERTIFICATE OF CORRECTION

PATENT NO. : 4,863,335

DATED : September 5, 1989

INVENTOR(S) : David P. Herigstad et al.

It is certified that error appears in the above-identified patent and that said Letters Patent is hereby corrected as shown below:

In claim 1, column 6, line 8, delete "of" and substitute therefor --off--.

Signed and Sealed this

Fourteenth Day of August, 1990

*Attest:*

HARRY F. MANBECK, JR.

*Attesting Officer*

*Commissioner of Patents and Trademarks*